US005191904A

United States Patent [19]

Arents et al.

[11] Patent Number: 5,191,904

[45] Date of Patent: Mar. 9, 1993

[54] TRASH REMOVAL APPARATUS AND METHOD

[75] Inventors: Robert A. Arents, Richmond; Everett C. Patterson, Midlothian, both of Va.

[73] Assignee: Philip Morris Incorporated, New York, N.Y.

[21] Appl. No.: 746,746

[22] Filed: Aug. 19, 1991

[51] Int. Cl.[5] ..... A24C 5/36

[52] U.S. Cl. ..... 131/96; 209/674; 209/393

[58] Field of Search ..... 131/96; 209/674, 393

[56] References Cited

U.S. PATENT DOCUMENTS

| | | | |
|---|---|---|---|
| 2,186,652 | 1/1940 | Orth et al. | 209/674 |
| 2,954,124 | 9/1960 | Young | 209/674 |
| 4,221,035 | 9/1980 | Thatcher | 209/44.1 |
| 4,278,100 | 7/1981 | Thatcher | 131/196 |
| 4,475,562 | 10/1989 | Thatcher et al. | 131/110 |
| 4,646,759 | 1/1990 | Thatcher et al. | 131/110 |

FOREIGN PATENT DOCUMENTS

| | | | |
|---|---|---|---|
| 0025493 | 1/1920 | Denmark | 209/674 |
| 3408269 | 9/1985 | Fed. Rep. of Germany . | |
| 0538063 | 7/1941 | United Kingdom | 209/674 |
| 0650717 | 2/1951 | United Kingdom | 209/393 |

OTHER PUBLICATIONS

Brochure Page and Photograph Regarding Separation systems from Franz Sagemuler GmbH, Nordstr. 30 D-2935, Bockhorn, Germany.

*Primary Examiner*—V. Millin
*Assistant Examiner*—J. Doyle
*Attorney, Agent, or Firm*—Mitchell P. Brook

[57] ABSTRACT

A trash removal system for separating trash and loose tobacco shreds from cigarettes that are rejected in cigarette manufacturing and packaging operations. A mixture comprising cigarettes, cigarette wrapper, trash and loose tobacco is metered onto a vibrating trash removal conveyor comprising a plurality of vertical plates arranged in a sinusoidally varying pattern.

27 Claims, 4 Drawing Sheets

FIG. 2
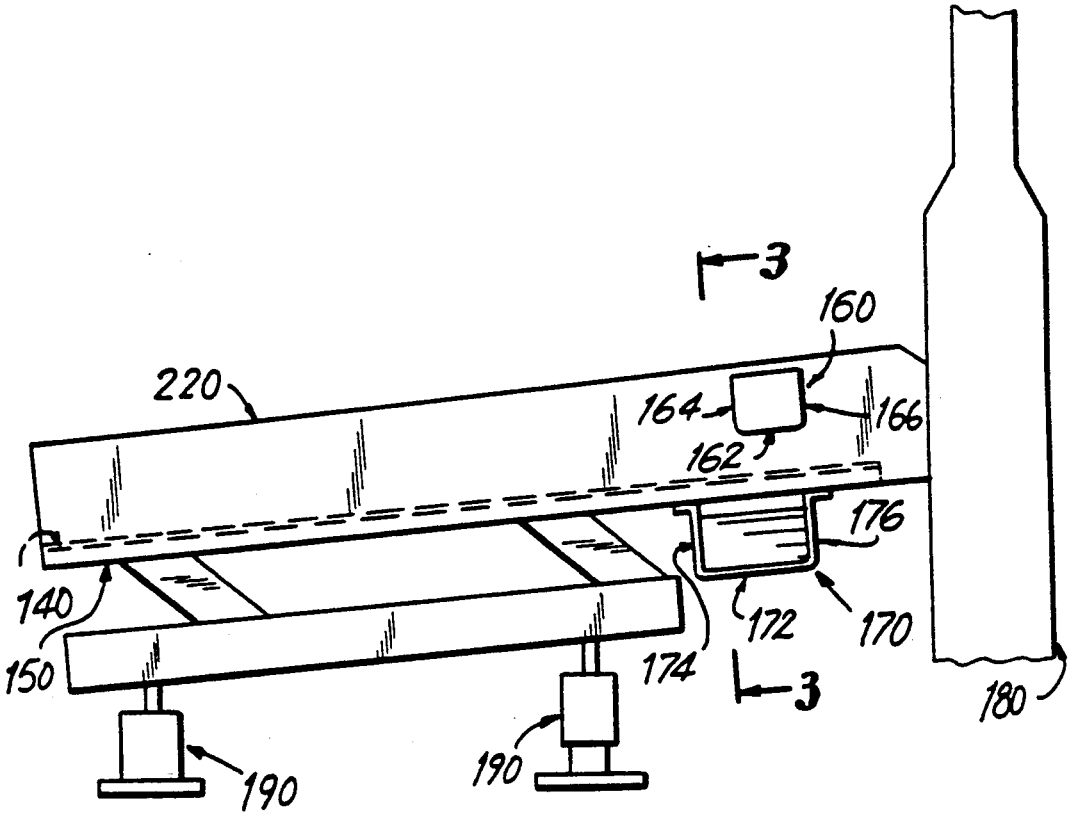
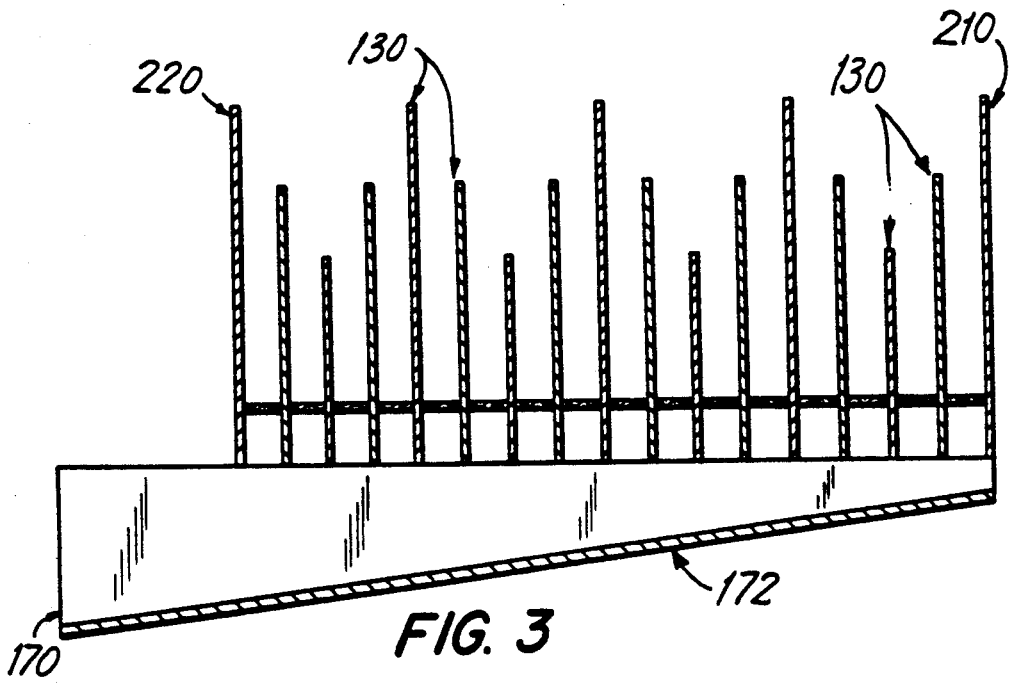
FIG. 3

TRASH REMOVAL APPARATUS AND METHOD

BACKGROUND OF THE INVENTION

The present invention relates to an apparatus and method for separating loose shreds of tobacco and large and small trash from rejected cigarettes. In the normal course of manufacturing, typically there are cigarettes that do not meet desired standards for product quality. For example, in some cigarettes, the wrapping paper might not be wrapped to a desireable level of firmness or there may be more or less tobacco than the desired amount, and hence those are not acceptable as consumer products. Monitoring of the manufacturing processes can result in large numbers of completely or partially manufactured cigarettes being rejected as unacceptable for these and other reasons. Rejected cigarettes typically are collected and removed from manufacturing areas so that cigarettes below the desired quality standards are not packaged, shipped or sold.

In cigarette manufacturing operations, rejected cigarettes can comprise as much as 5% of the total number of cigarettes manufactured. Therefore, a sizeable amount of tobacco (an expensive commodity) must be destroyed unless the tobacco contained in the rejected cigarettes can be reclaimed. Reclaiming the tobacco requires that the tobacco be separated from other rejected cigarette constituents such as wrapping paper, filter plugs, filter plug wrap and cigarette cartons and other packaging materials. Large and small trash, such as chewing gum wrapping paper, pencils, tools, bolts, loose wrapper paper, loose filters, loose cartons and other packaging materials and other miscellaneous trash, may also become intermingled with rejected cigarettes from the cigarette manufacturing operations. Reclaiming tobacco therefore additionally requires separating the rejected cigarettes from a mixture also comprising large and small trash. Loose tobacco shreds, either from the rejected cigarettes themselves or other sources, also typically become intermingled with the rejected cigarette mixture.

It is known to separate trash from rejected cigarettes using various apparatus such as conventional wire mesh screens. It is also known to use a separation system having parallel vertical plates, generally of the same height, such as Model No. BFQ1100 made by Franz Sagemuler GMBH, Nordstr. 30 D-2935, Bockhorn, Germany. The vertical plates are arranged such that the top surface of each is at the same level, except that every fifth plate is elevated. In the Sagemuler system, loose tobacco shreds are screened out before the rejected cigarette mixture enters the vertical plate system. Large trash falls off the end and is collected in a container. Its typical maximum capacity is 2500 lbs. of mixture/hr. Operation of the Sagemuler system at higher speeds tends to result in cigarettes being lost due to overloading.

DEFINITIONS

As used herein and in the claims that follow, the following terms have the indicated meanings:

"Wrapper" and "wrapping material: May include paper or other material in which a cigarette rod is, or may be, encased, filter plugs, filter wrap or tipping paper.

"Tobacco", "filler" and "tobacco filler": May include tobacco or other filler material such as tobacco substitutes, stems or reconstituted tobacco which has been cut, shredded, extruded or otherwise prepared for incorporation in a tobacco product.

"Shred": A piece of any filler.

"Cigarette": A smoking article and its various components—which may or may not be intended to be burned.

"Oven-Volatiles Content" (OV): A unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles content. The weight loss is attributable to volatiles in addition to water but OV is used interchangeably with moisture content and may be considered equivalent thereto since generally, at the test conditions, not more than about 0.9% of the tobacco filler weight is volatiles other than water.

SUMMARY OF THE INVENTION

The present invention comprises an apparatus and method for removing large and small trash from cigarettes that are rejected in cigarette manufacturing and packaging operations and for separating loose tobacco shreds from such rejected cigarettes. In accordance with the present invention, loose cigarettes with trash and loose tobacco shreds are metered onto a vibrating trash removal conveyor. The trash removal conveyor has parallel vertically oriented plates of varying heights that run the length of the conveyor. The vertical plates are mounted to the conveyor such that the top surfaces of the plates have a pattern comprising three or more varying heights. Preferably the pattern comprises sinusoidally varying heights. The vibrating action of the trash removal conveyor (in concert with gravity) generally causes the cigarettes and any small trash smaller than the distance between the plates to fall between the plates. Large trash, which is trash That is too large to fit between the plates, generally remains on top of the plates. Loose tobacco also falls between the plates. Below the vertical plates is a screen with a mesh size that is large enough to allow loose tobacco shreds to fall through, but small enough such that small trash and cigarettes generally will not fall through and will remain on top of the screen. Below the screen is a solid surface such that any material that falls through the screen is caught by the surface.

In operation, the vibrating action of the trash removal conveyor also causes the materials on the conveyor (i.e. cigarettes, large and small trash and loose tobacco) to move along the conveyor from the first end where materials are placed onto the trash removal conveyor towards the opposite (second) end. Towards the end of the conveyor, the large trash falls into a receptacle, such as a vibrating pan, and is conveyed away from the trash removal system. Any material that has fallen through the screen and into the trough, primarily loose tobacco shreds, moves along the trough until it reaches a slot that it falls through and lands in a receptacle, such as a belt conveyor, and is conveyed away from the trash removal system. The cigarettes and loose trash move on top of the screen to a density separator, such as a pneumatic air leg, where the cigarettes are separated from the small trash. The cigarettes are conveyed away for further processing to remove tobacco. The small trash is conveyed away and discarded, recycled or reused, whichever is desired.

The present invention may be used in conjunction with the method and apparatus for separating tobacco from rejected cigarettes as described in commonly assigned U.S. Pat. No. 4,278,100. It may also be used separately or in conjunction with other apparatus.

An advantage of the present invention is that loose tobacco shreds can be screened out on the trash removal conveyor in conjunction with the vertical plate system, rather than in a separate operation before the rejected cigarette mixture is metered on to the vertical plates.

A further advantage of the present invention is that large trash can be automatically conveyed away from the trash removal conveyor.

A still further advantage is derived from the pattern of the vertical plates and the simultaneous screening and collection of large trash is that rejected cigarette containing mixtures can be processed at higher speeds than was possible with prior trash removal conveyors. Speeds as high as 6000 lbs. of mixture/hr. are possible. In addition, at comparable speeds, a more thorough separation of components is achieved. An advantage of operating at higher speeds is that the trash removal conveyor can be integrated with other high speed apparatus, such as high speed ripper systems.

It is an object of the present invention to provide a reliable and effective way of separating large and small trash from the loose rejected cigarettes.

It is a further object of the present invention to provide a reliable and effective way of collecting loose tobacco shreds that are intermingled with large and small trash or rejected cigarettes.

It is yet a further object of the present invention to provide a vibrating trash removal conveyor that processes cigarette containing mixtures at high speeds, such as over 2500 lbs. of mixture/hr.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout and in which:

FIG. 2 is a side view of a trash removal conveyor and density separator according to the invention;

FIG. 3 is a cross-section of the trash removal conveyor of FIG. 2, taken from line 3—3 of FIG. 2;

DETAILED DESCRIPTION OF THE INVENTION

The various components of a rejected cigarette mixture 10 containing any combination of large trash, small trash, loose tobacco shreds and rejected cigarettes are separated by metering the mixture 10 onto a vibrating trash removal conveyor 20, which separates the components.

In a typical cigarette manufacturing facility, the composition of the mixture 10 will vary from batch-to-batch or from cigarette maker-to-cigarette maker, depending on the nature of the rejected cigarette flow and the composition of the extraneous trash that gets mixed in with the collection of rejected cigarettes from the cigarette manufacturing areas. In the present invention, the mixture may contain any proportion of each of the components (i.e. large and small trash, loose tobacco and cigarettes).

Figure 1:
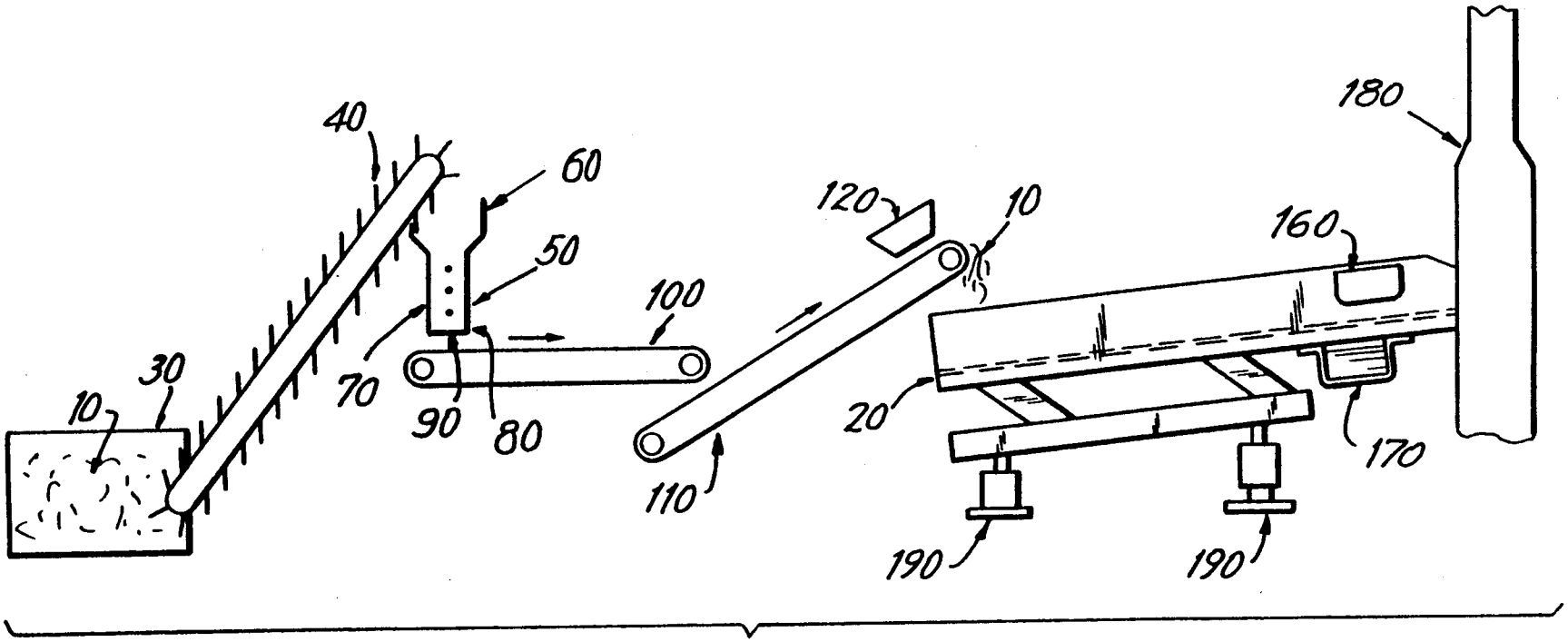
FIG. 1 is a side view of a trash removal system according to the invention.
Figure 4:
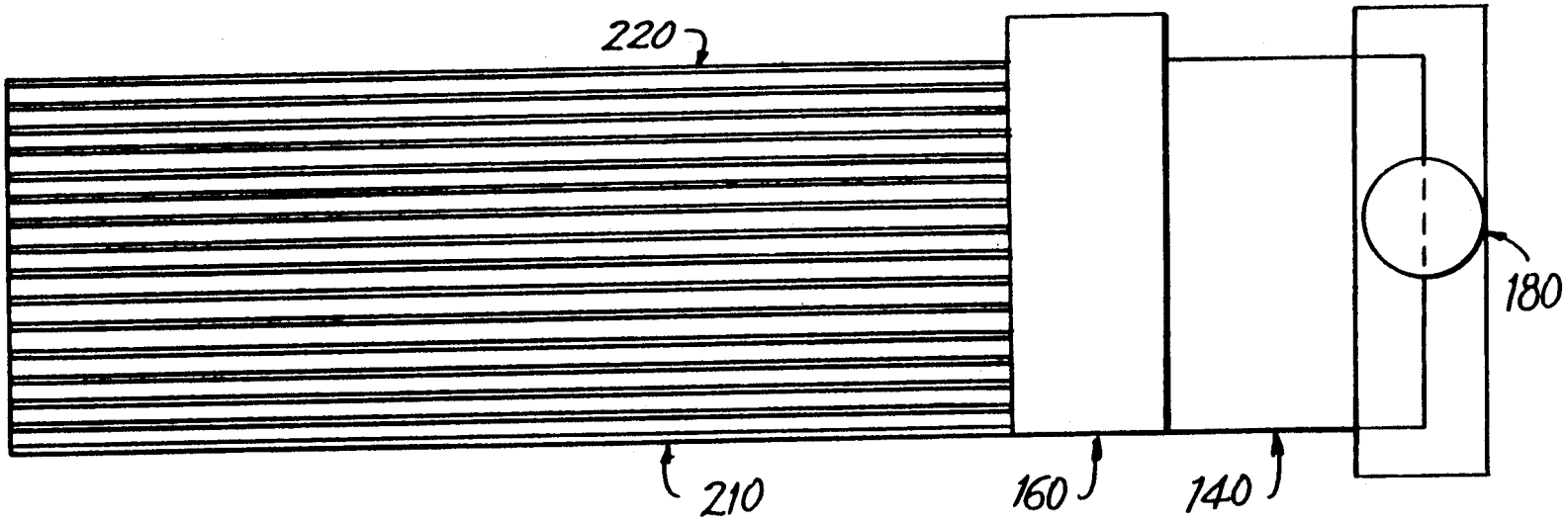
FIG. 4 is a top view of the trash removal conveyor of FIG. 2.

The mixture 10 may be metered onto the trash removal conveyor. 20 using any means, including without limitation funnels, vibrating conveyors, transport belts and shovels. In the embodiment depicted in FIG. 1, the mixture is collected from the cigarette makers and transferred to a storage bin 30. The mixture 10 is then transferred by an inclined conveyor belt 40 to a metering apparatus 50. Any type of metering apparatus may be used. As shown in FIG. 1, the mixture 10 can be fed from the inclined conveyor belt 40 to a hopper 60.

Since the trash removal system of the present invention may be used in conjunction with ripper operations or other tobacco and cigarette processing operations, it may be desired (for the benefit of those other operations) to raise the moisture content of the mixture 10 from the 12.5% OV that is common in rejected cigarette tobacco. Moisture may be injected into the mixture in order to raise the moisture content. In a preferred embodiment, the hopper 60 feeds the mixture 10 into a steam tube chamber 70. Steam is injected into the mixture 10 in the steam tube chamber 70 in order to raise the moisture level of the mixture 10 to a desired level. Preferably, a level of 13.5%-14.5% OV is attained although other OV levels may be used.

The amount of moisture absorbed by the mixture 10 may be regulated by adjusting the amount of time in which the mixture is in the steam tube chamber 70 and the steam pressure. As steam pressure increases, the amount of moisture absorbed also increases. Likewise, as the amount of time increases, the moisture level typically increases. One way to adjust the amount of time in which the mixture 10 remains in the steam tube chamber 70 is to control the height of the mixture present in the steam tube chamber 70 (as measured from the bottom 80 of the steam tube chamber). One way to control the height of the mixture is to use a control mechanism that senses the height using a vertical array of photo-electric cells 90; then, when &he height is too low, the rate at which the inclined feeder belt 40 feeds mixture 10 into the hopper 60 is increased; and, conversely, when the height is too high, the rate at which the inclined feeder belt 40 feeds mixture 10 into the hopper 60 is decreased. It also has been observed that if the height of the mixture is too low, condensation can occur on the walls of the steam tube chamber and the mixture can get wet.

In addition to the components described above, the metering apparatus 50 shown in FIG. 1 contains a metering belt 100 and a feeder belt 110. Preferably, the speed of the metering belt 100 can be adjusted in order to control the rate at which the mixture 10 is fed onto the feeder belt 110 and the trash removal conveyor 20. The feeder belt transports the metered mixture 10 to the trash removal conveyor 20. Other means of conveyance also may be used to perform the functions of the metering belt 100 and the feeder belt 110, such as vibrating conveyors or hand conveyors such as barrels or trucks.

Preferably a metal removal system 120 operates to remove metallic objects that are in the mixture 10 before the mixture is fed onto the trash removal conveyor 20.

The metal removal system may be located anywhere in the metering apparatus. In the preferred embodiment, it is located near the end of the feeder belt 110. Although metallic objects can be removed manually, it is preferred that a magnet be used. One drawback of using a magnet is that it will only remove ferrous objects. However, it is generally more economical to use a magnet.

As shown in FIGS. 1–5, the trash removal conveyor of the present invention generally has a number of parallel vertically oriented plates 130 separated by spaces of a predetermined width, a screen 140 below the plates, a surface 150 for collecting materials that fall through the screen, a receptacle 160 for collecting large trash, another receptacle 170 for collecting and conveying material from surface 150, a density separator 180, and a means 190 for vibrating the trash removal conveyor 20.

In operation, the mixture 10 is metered onto the trash removal conveyor 20, which is vibrating. The vibrating means 190 causes the trash removal conveyor 20 to vibrate. The vibrating action causes materials on the conveyor (including any of its parts), including the components of the mixture 10, to move along the trash removal conveyor from the first end where the mixture 10 is metered onto the conveyor towards the opposite end.

The operation of vibrating conveyors is widely known. Any vibrating means may be used, including any of the widely used means. In the preferred embodiment, the vibrating means 190 causes the trash removal conveyor 20 to move in a concentric motion with a $\frac{7}{8}$ in. stroke. This causes the mixture 10 and its components to move along the conveyor at approximately 60 ft./min.

The plates 130 are vertically oriented and may be held in place by any means, such as mounting rods 200 that pass through each plate and are attached to at least one of the two sidewalls 210, 220 of the trash removal conveyor. The mounting rods 200 may be attached to the sidewalls 210, 220 by any means, as long as they cannot move vertically. Slippage, such as in the horizontal or axial directions, may be tolerated, but preferably the mounting rods 200 are immovably attached to the sidewalls 210, 220.

Figure 5:
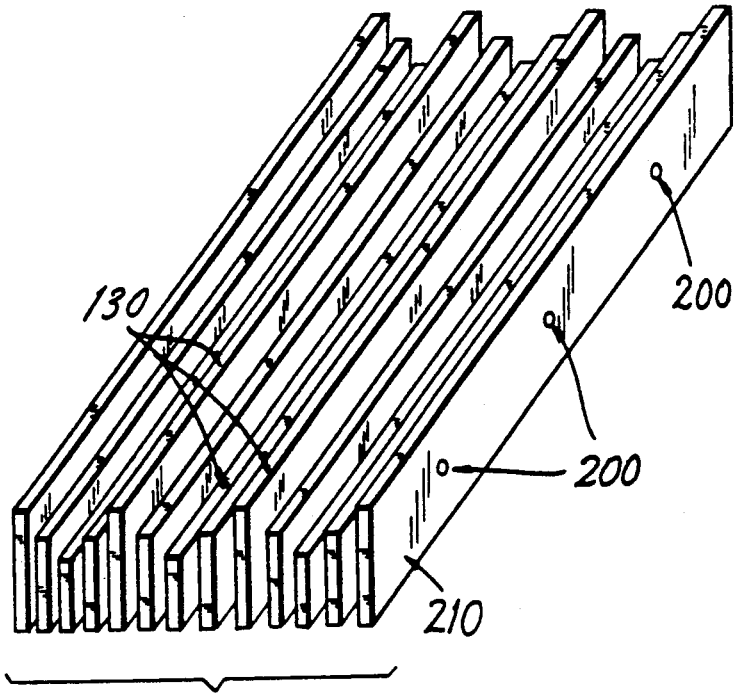
FIG. 5 is a perspective view of the vertical plates of the trash removal conveyor of FIG. 2.
Figure 6:
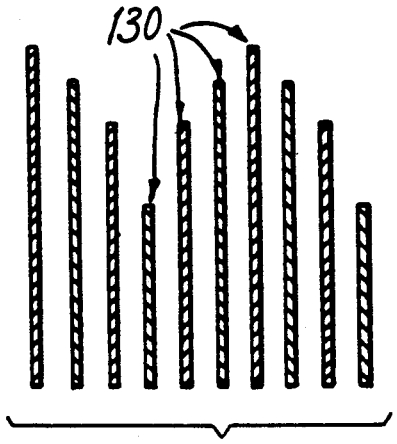
FIG. 6 is a cross-section of a trash removal conveyor which has four levels of vertical plates.

The top surfaces of the plates 130 are arranged in a predetermined pattern to promote separation of the various components of the mixture 10. It has been determined that a sinusoidal arrangement, as depicted in FIGS. 3, 5 and 6, achieves the best results. In such an arrangement, there are three or more levels at which the top surfaces of the plates 130 are set. They are arranged such that a plate with its top surface being at the highest level has next to it at least one plate with a lower top surface, with a space in-between. The top surfaces of the next plates are succeedingly lower until a plate with its top surface at the lowest level is reached. Then the top surfaces get higher until a plate with its top surface being at the highest level is reached. This pattern is repeated until the area between the two side walls 210, 220 of the trash removal conveyor is populated with plates 130 and spaces between the plates. FIGS. 3 and 5 depict the preferred embodiment in which there is a sinusoidal arrangement of plates 130 having three top surface levels. FIG. 6 shows an alternative embodiment in which there is a sinusoidal arrangement of plates 130 having four top surface levels. Other arrangements of plates 130 in which the plates have various levels also may be used.

The screen 140 is located below the plates 130. In operation, the screen 140 functions to separate loose tobacco from the mixture 10. The mesh size of the screen therefore may be any size that is large enough to allow loose tobacco shreds to pass through. As the mesh size selected increases, the likelihood that all loose tobacco shreds will be able to pass through increases. However, as the mesh size increases, the likelihood that some small trash, such as loose filters and cigarette paper can pass through also increases. Preferably, the mesh size also is sufficiently small such that most small trash, such as loose filters and cigarette wrapper, cannot pass through In the preferred embodiment, a $3\frac{1}{2}$ mesh per linear inch screen is used.

A surface 150, such as a trough, is located below the screen 140 such that any material that passes through the screen is retained on the surface 150. The surface 150 is constructed such that the material that passes through the screen 140 does not adhere to the surface 150. In operation, it is desired that material on the surface the caused by the vibrating action of the trash removal conveyor to move along the surface 150 from the first end (where the mixture 10 is metered onto the trash removal conveyor) towards the opposite (second) end.

A receptacle 170 is located such that material that is conveyed along the surface 150 falls into the receptacle 170. In operation, the material that has fallen through the screen, primarily loose tobacco shreds, moves along the surface 150 until it reaches a slot in the surface 150, which it falls through. The material then may be collected from the receptacle 170 by any means and transferred for further processing. In one embodiment, the receptacle 170 is a trough having vertical side walls and a belt conveyor as its bottom surface. In a preferred embodiment, the receptacle 170 is a trough having an angled bottom surface 172 and a front wall 174 and a rear wall 176. The front and rear walls 174, 176 may be vertical or angled. In this preferred embodiment the material that falls through the slot and into the trough 170 is caused by the vibrations of the trash removal conveyor to be conveyed in the direction of the angled bottom surface 172.

Large trash, which is defined as trash that is too large to fit between the vertical plates 130, is collected in a large trash receptacle 160. In operation, the large trash is conveyed along the top surfaces of the plates 130 until it reaches the large trash receptacle 160. The large trash then may be collected from the receptacle 160 by any means and transferred for further processing or for disposal as waste. In one embodiment, the receptacle 160 is a pan having vertical side walls and a belt conveyor as its bottom surface. In a preferred embodiment, the receptacle 160 is a pan having an angled bottom surface 162 and a front wall 164 and a rear wall 166. In this preferred embodiment the large trash in the pan 160 is caused by the vibrations of the trash removal conveyor to be conveyed in the direction of the angled bottom surface 162.

A density separator 180 is located at the second end of the trash removal conveyor. In operation, materials in the mixture 10 that are small enough to fall between the plates 130, but are too large to pass through the screen 140, are conveyed along the top surface of the screen 140 from the first end to the density separator. Generally, these materials that are conveyed into the density separator 180 are rejected cigarettes and small trash including, inter alia pieces of loose wrapper and filters. Generally, the rejected cigarettes have a higher density than the other materials. The density separator 180 separates the rejected cigarettes from the other material. In the preferred embodiment, the density separator is a pneumatic air leg. In such a pneumatic air leg, an air stream is directed upwards; material enters into the air stream; materials with a higher density tend to fall downwards if the force of gravity is greater than the upward force caused by the drag created by the airstream; and materials with a lower density rise in the direction of the airstream if the force of gravity is less than the drag created by the airstream. In operation, the cigarettes fall downwards and are collected and transferred for further processing. The small trash, such as wrapper paper and filter plug wrap filters, rises with the airstream and is collected for further processing (such as recycling or further separation) or disposal. In a preferred embodiment, the airstream velocity is at least 300 ft./min.

What is claimed is:

1. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a pattern comprising at least three levels;

a vibrating means for vibrating the trash removal conveyor; and a screen means that is mounted on the trash removal conveyor below the vertical plates.

2. The apparatus of claim 1 further comprising a surface that is mounted on the trash removal conveyor below the screen such that any material passing through the screen is retained on the surface.

3. The apparatus of claim 2 further comprising a tobacco shred receptacle means that is mounted below the surface such that material that is conveyed along the surface from the first end towards the second end of the trash removal; conveyor impinges upon an opening in the surface, below which is the tobacco shred receptacle means.

4. The apparatus of claim 3 wherein the tobacco shred receptacle means is a trough having an angled bottom surface.

5. The apparatus of claim 3 wherein the tobacco shred receptacle means is a trough having a belt conveyor on its bottom surface.

6. The apparatus of claim 2 wherein the surface is a trough.

7. The apparatus of claim 1 further comprising a density separator that is mounted at the second end of the trash removal conveyor such that components of the mixture that are too large to pass through the screen but small enough to fit between the vertical plates enters the density separator.

8. The apparatus of claim 7 wherein the density separator is an air leg.

9. The apparatus of claim 1 wherein the screen means comprises a screen with a mesh size that is large enough to allow loose tobacco shreds to pass through.

10. The apparatus of claim 9 wherein the screen means comprises a 3½ mesh per linear inch screen.

11. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a pattern comprising at least three levels;

a vibration means for vibrating the trash removal conveyor; and a large trash receptacle that is mounted below the level of all of the top surfaces of the vertical plates such that it collects large trash that is conveyed along the top surfaces of the vertical plates from the first end towards the second end of the trash removal conveyor.

12. The apparatus of claim 11, wherein the large trash receptacle is a pan that has an angled bottom surface.

13. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a pattern comprising at least three levels;

a vibrating means for vibrating the trash removal conveyor;

a metering means for meting the mixture onto the first end of the trash removal conveyor; and a metal removal means for removing metallic objects from the mixture before the mixture is metered onto the trash removal conveyor.

14. The apparatus of claim 13 wherein the metal removal means is a magnet.

15. The apparatus of claim 13 wherein the metering means comprises a metering belt.

16. The apparatus of claim 15 wherein the metering means further comprises a feeder belt.

17. The apparatus of claim 15 wherein the speed of the metering belt can be charged in order to control the rate of metering.

18. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a pattern comprising at least three levels;

a vibrating means for vibrating the trash removal conveyor;

a metering means for metering the mixture onto the first end of the trash removal conveyor; and a moisture adjusting means for regulating the moisture content of the mixture before it is metered by the metering means onto the trash removal conveyor.

19. The apparatus of claim 18 wherein the moisture adjusting means is a steam tube chamber.

20. The apparatus of claim 19 wherein the steam tube chamber comprises a control means for sensing level of mixture within the steam tube chamber.

21. The apparatus of claim 20 wherein the control mechanism comprises an array of photo-electric sensors.

22. An apparatus for separating the components of a mixture comprising cigarettes, cigarette wrapper, large trash, small trash and loose tobacco, comprising:

a trash removal conveyor having a first end and a second end, wherein said trash removal conveyor comprises:

a plurality of vertical plates each of which has a top surface, the top surfaces being arranged in a pattern comprising at least three levels;

a mounting means for attaching the vertical plates to the trash removal conveyor;

a screen means that is mounted on the trash removal conveyor below the vertical plates;

a surface that is mounted on the trash removal conveyor below the screen such that any material passing through the screen is retained on the surface;

a tobacco shred receptacle means that is mounted below the surface such that material that is conveyed along the surface from the first end towards the second end of the trash removal conveyor impinges upon an opening in the surface into the tobacco shred receptacle means;

a large trash receptacle that is mounted below the level of all of the top surfaces of the vertical plates such that it collects large trash that is conveyed along the top surfaces of the plates from the first end towards the second end of the trash removal conveyor;

a density separator that is mounted at the second end of the trash removal conveyor such that components of the mixture that are too large to pass through the screen but small enough to fit between the vertical plates enters the density separator; said apparatus further comprising:

a vibrating means for vibrating the trash removal conveyor; and a metering means for metering the mixture onto the first end of the trash removal conveyor.

23. A method of separating the components of a mixture comprising cigarettes, cigarette wrapper, large trash, small trash and loose tobacco, comprising the steps of:

causing a trash removal conveyor having a first end and a second end to vibrate such that materials placed on the trash removal conveyor move from the first end to the second end; said trash removal conveyor comprising:

a plurality of vertical plates each of which has a top surface, the top surfaces being arranged in a pattern comprising at least three levels; and a screen means that is mounted on the trash removal conveyor below the vertical plates; said method further comprising:

metering the mixture onto the first end of the trash removal conveyor, which is vibrating such that the components of the mixture are caused to move from the first end of the trash removal conveyor in the direction of the second end;

collecting loose tobacco shreds that pass through the screen;

collecting large trash that is conveyed along the top surfaces of the plates; and separating components of the mixture that are too large to pass through the screen but small enough to fit between the vertical plates.

24. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a sinusoidal pattern comprising at least three levels;

a vibrating means for vibrating the trash removal conveyor; and a screen means that is mounted on the trash removal conveyor below the vertical plates.

25. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a sinusoidal pattern comprising at least three levels;

a vibrating means for vibrating the trash removal conveyor; and a large trash receptacle that is mounted below the level of all of the top surfaces of the vertical plates such that is collects large trash that is conveyed along the top surfaces of the vertical plates from the first end towards the second end of the trash removal conveyor.

26. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a sinusoidal pattern comprising at least three levels;

a vibrating means for vibrating the trash removal conveyor; and a metering means for metering the mixture onto the first end of the trash removal conveyor; and a metal removal means for removing metallic objects from the mixture before the mixture is metered onto the trash removal conveyor.

27. An apparatus for separating the components of a mixture comprising cigarettes, cigarette wrapper, large trash, small trash and loose tobacco, comprising:

a trash removal conveyor having a first end and a second end, wherein said trash removal conveyor comprises a plurality of vertical plates each of which has a top surface, the top surfaces being arranged in a sinusoidal pattern comprising at least three levels;

a vibrating means for vibrating the trash removal conveyor; and a metering means for metering the mixture onto the first end of the trash removal conveyor; and a moisture adjusting means for regulating the moisture content of the mixture before it is metered by the metering means onto the trash removal conveyor.

* * * * *